US007460676B2

(12) United States Patent
Morimoto

(10) Patent No.: US 7,460,676 B2
(45) Date of Patent: Dec. 2, 2008

(54) HEADPHONE DRIVING CIRCUIT

(75) Inventor: Masashi Morimoto, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 1492 days.

(21) Appl. No.: 10/392,841

(22) Filed: Mar. 21, 2003

(65) Prior Publication Data

US 2004/0091121 A1 May 13, 2004

(30) Foreign Application Priority Data

Nov. 13, 2002 (JP) ..... 2002-329371

(51) Int. Cl.
*H04R 1/10* (2006.01)
*H04R 5/00* (2006.01)

(52) U.S. Cl. ..... 381/74; 381/309; 381/1

(58) Field of Classification Search ..... 381/1, 381/74, 309, 17–21, 27–28, 400–402
See application file for complete search history.

(56) References Cited

U.S. PATENT DOCUMENTS 4,349,698 A * 9/1982 Iwahara ..... 381/1
4,586,192 A * 4/1986 Arntson ..... 381/303
4,819,269 A * 4/1989 Klayman ..... 381/307
5,175,768 A * 12/1992 Daniels ..... 381/309
5,592,559 A 1/1997 Takahashi et al.
5,594,801 A * 1/1997 McShane ..... 381/300
5,761,313 A * 6/1998 Schott ..... 381/1
6,038,323 A * 3/2000 Petroff ..... 381/1
7,171,011 B2 * 1/2007 Morimoto ..... 381/120

FOREIGN PATENT DOCUMENTS

JP 63-3619 1/1988
JP 11-317629 11/1999
JP 2001-144561 5/2001
JP 2001-148894 5/2001

* cited by examiner

*Primary Examiner*—Xu Mei
(74) *Attorney, Agent, or Firm*—Volentine & Whitt, PLLC

(57) ABSTRACT

This invention may provide a headphone driving circuit needless of coupling condenser even if the power supply supplies a single output voltage. The headphone driving circuit comprises (1) a first amplifier to amplify a first composite signal generated by subtracting a second channel audio signal from a first channel audio signal, then driving one end of a first voice coil of a stereo-headphone, (2) a second amplifier to amplify a second composite signal generated by subtracting the first channel audio signal from the second channel audio signal, then driving one end of a second voice coil of the stereo-headphone, (3) a third amplifier to amplify a third composite signal generated by adding the first channel audio signal and the second channel audio signal for driving the other end of the first and the second voice coil of the stereo-headphone.

12 Claims, 2 Drawing Sheets

HEADPHONE DRIVING CIRCUIT

FIELD OF THE INVENTION

The invention relates to an acoustic signal driving circuit for driving a headphone and a speaker.

BACKGROUND OF THE INVENTION

A system of a speaker driving circuit for reproducing a stereophonic audio signal outputted from a personal computer via USB interface is introduced in Japanese laid open patent No. 2001-148894.

This system includes a decoder 15 that generate an audio signal L, R by decoding an audio data outputted from a personal computer via USB interface circuit 14, a sound volume control circuit 16 that control a level of generated audio signal L, R. The sound volume control circuit 16 is equipped with an amplifier 17L that amplify an acoustic level of a left channel audio signal in non-inverted mode, amplifier 17R that amplify an acoustic level of a left channel signal in inverted mode. Also equipped is a terminal of a voice coil of the speaker 18L, 18R each connected to the output of the amplifier 17L, 17R, and the other terminal of the voice coil is connected to ground level (GND).

The USB interface circuit 14, decoder 15, sound volume control circuit 16, and amplifier 17L, 17R are designed to operate by a power supply voltage of 5V, 0.1 A supplied by the personal computer via USB interface. The impedance of the voice coil of the speaker 18L, 18R are 32 Ω and the efficiency of the speaker is as high as 90 dB/W, so sufficient volume of acoustic power reproduction can be possible.

However, according to the above-mentioned system, there exist some problems. Namely, when the amplifier 17L, 17R is supplied by a single 5V power supply, the output of these amplifier are biased by a constant DC voltage. Accordingly bias current flows to the GND via voice coil independently with or without an audio signal, therefore futile power consumption occurs.

To avoid this bias current problem, the speakers 18L, 18R should be connected to each amplifier via coupling condenser, but if the system is designed for audio signal of frequency range 20 Hz-20 KHz, the requisite capacity of the coupling condenser is almost 250 μF for the speaker with 32 Ω impedance. Consequently it is difficult to implement such a large capacitive condenser to a portable device with a headphone.

SUMMARY OF THE INVENTION

This invention may provide a headphone driving circuit needless of coupling condenser even if the power supply supplies a single output voltage. The headphone driving circuit comprises (1) a first amplifier to amplify a first composite signal generated by subtracting a second channel audio signal from a first channel audio signal, then driving one end of a first voice coil of a stereo-headphone, (2) a second amplifier to amplify a second composite signal generated by subtracting the first channel audio signal from the second channel audio signal, then driving one end of a second voice coil of the stereo-headphone, (3) a third amplifier to amplify a third composite signal generated by adding the first channel audio signal and the second channel audio signal, then driving the other end of the first and the second voice coil of the stereo-headphone.

BRIEF DESCRIPTION OF THE DRAWINGS

The invention will be more particularly described with reference to the accompanying drawings, in that.

DETAILED DESCRIPTION OF THE PREFERRED EMBODIMENTS

In the first through third embodiments, the same reference numbers designate the same or similar components.

First Preferred Embodiment

Figure 1:
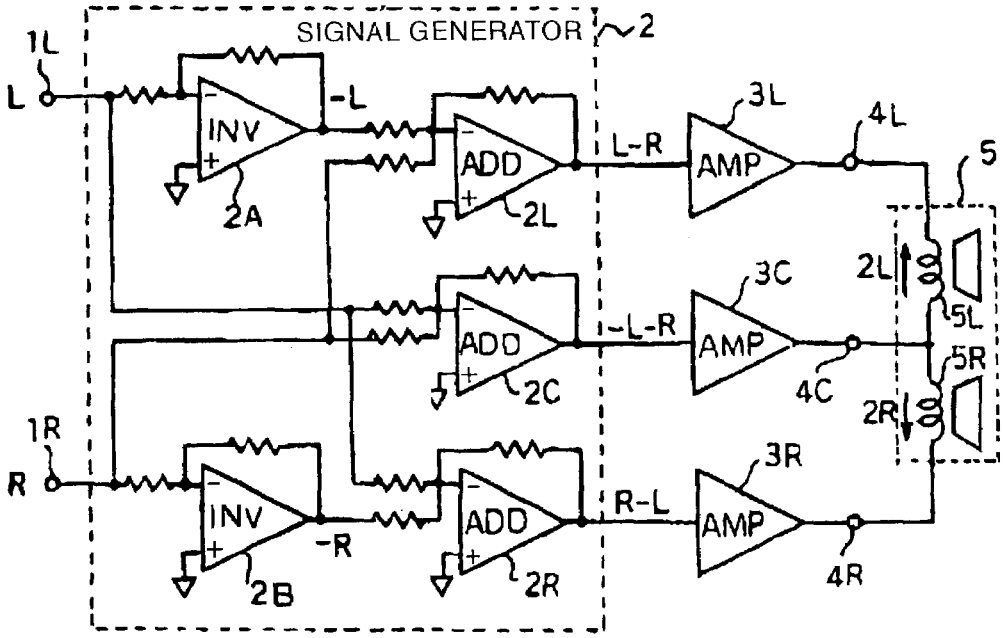
FIG. 1 is a block diagram of a first preferred embodiment of a headphone driving circuit of the invention.

FIG. 1 shows a first preferred embodiment of the headphone driving circuit according to the invention. This headphone driving circuit includes input terminal 1L, 1R that is coupled to each of a left channel audio signal L and a right channel audio signal R, and the input terminal 1L, 1R is connected to the signal generator 2. The signal generator 2 generates a first differential signal (L−R), a second differential signal (R−L) and a inverted addition signal (−L−R) from the left channel audio signal L and the right channel audio signal R.

The signal generator 2 includes, for example, a inverting-type amplifier (INV) 2A, 2B and adder (ADD) 2L, 2R, 2C. The INV 2A, 2B each inverts the polarity of the left channel audio signal L and the right channel audio signal R. The ADD 2L adds the output signal from the INV 2A and the left channel audio signal R, and inverts the addition signal to generate a difference signal (L−R). The adder 2R adds the output signal from the INV 2B and the left channel audio signal L, and inverts the addition signal to generate a difference signal (R−L). The ADD 2C adds the left channel audio signal L and the right channel audio signal R, and inverts the addition signal polarity to generate a inverted addition signal (−L−R).

The output of the adder 2L, 2R 2C of signal generator 2 is each connected to the input of the power amplifier (AMP) 3L, 3R, 3C. The power amplifier 3L amplifies the difference signal (L−R) from the ADD 2L, and outputs the amplified signal to the terminal 4L. The power amplifier 3R amplifies the difference signal (R−L) from the ADD 2R, and outputs the amplified signal to the terminal 4R. The power amplifier 3C amplifies the difference signal (−L−R) from the ADD 2C, and outputs the amplified signal to the terminal 4C.

The output terminal 4L, 4R, 4C are used to connect headphone 5. The output terminal 4L, 4R are connected to one end or the other end of the left and right voice coil terminal 5L, 5R of the headphone 5, and the common end of the voice coil 5L, 5R is connected to the common terminal 4C.

Next, the operation of above-mentioned system is described.

When the left channel audio signal L and the right channel audio signal R are applied to each input terminal 1L, 1R, the signal generator 2 generates difference signal (L−R), (R−L), and inverted addition signal (−L−R). The difference signal (L−R) is amplified by power amplifier 3L and outputted to the terminal 4L. Similarly the difference signal (R−L) is amplified by power amplifier 3R and outputted to the terminal 4R. The inverted addition signal (−L−R) is amplified by power amplifier 3C and outputted to the terminal 4C.

Since the left channel voice coil 5L of the headphone extends between the terminal 4L, 4C, and the right channel audio signal R from the power amplifier 3L, 3C is in-phase, therefore only twice the left channel audio signal 2L is applied to the voice coil 5L, and a DC biasing voltage is cancelled.

Similarly since the right channel voice coil 5R of the headphone extends between the terminal 4R, 4C, and the left channel audio signal L from the power amplifier 3R, 3C is in-phase, therefore only twice the right channel audio signal 2R is applied to the voice coil 5R.

According to the first preferred embodiment as described above, the headphone driving circuit includes signal generator 2 to generate the first difference signal (L−R), second difference signal (R−L), and inverted adding signal (−L−R) from the left channel audio signal L and the right channel audio signal R, the power amplifier 3L, 3R, 3C to amplify each of the power of the audio signals from signal generator 2. By this, twice the left channel audio signal 2L is applied to the voice coil 5L, and twice the right channel audio signal 2R is applied to the voice coil 5R. Therefore powerful acoustic sound according to the signal 2L,2R are reproduced by using relatively low power amplifiers. In addition a biasing voltage included in each output signal of power amplifier is canceled even if power amplifier 3L, 3R, 3C with a single power supply is used. Therefore there needs no coupling condenser at each output terminal of the amplifier.

Second Preferred Embodiment

Figure 2:
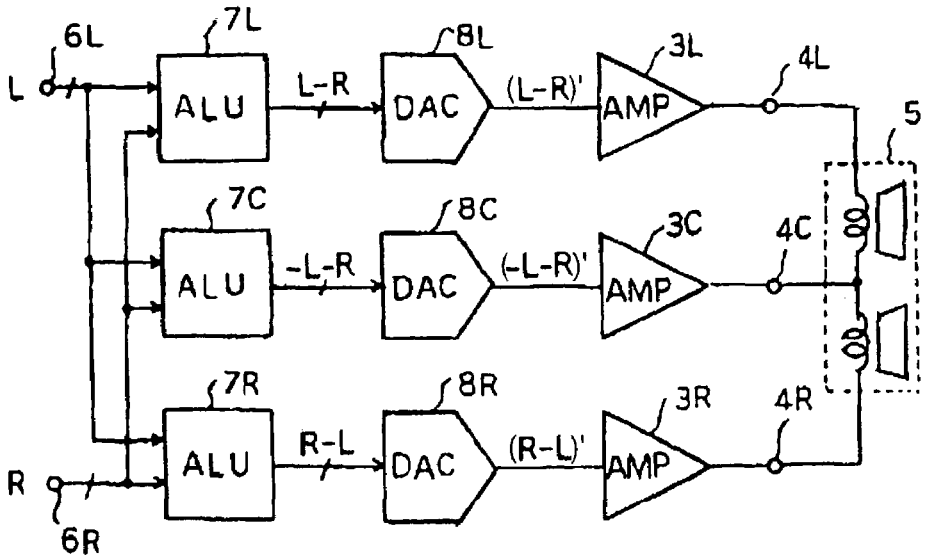
FIG. 2 is a block diagram of a second preferred embodiment of a headphone driving circuit of the invention.

FIG. 2 is a block diagram showing a headphone driving circuit of a second preferred embodiment of the invention.

This headphone driving circuit includes input terminal 6L, 6R. A digitized left channel audio signal L, and a digitized right channel audio signal R, for example, a modulated signal by Pulse Code Modulation (PCM) is applied to each terminal. The input terminal 6L, 6R is each connected to an Arithmetic Logic Unit (ALU) 7L, 7R, 7C to perform adding and subtraction operation.

The ALU 7L subtracts the right channel audio data R from the left channel audio data L to generate a first difference data (L−R). The ALU 7R subtracts the left channel audio data L from the right channel audio data R to generate a second difference data (R−L). The ALU 7C adds the right channel audio data R and the left channel audio data L and inverts the sign of the adding result to generate inverted addition data (−L−R).

The output of each ALU 7L, 7R, 7C is each connected to Digital to Analogue Converter (DAC) 8L, 8R, 8C. The DAC 8L converts the difference data (L−R) from the ALU 7L to analogue difference signal (L−R)'. Similarly the DAC 8R converts the difference data (R−L) from the ALU 7R to analogue difference signal (R−L)'. The DAC 8C converts the inverted addition data (−L−R) from the ALU 7C to analogue inverted addition signal (−L−R)'.

The output terminal of DAC 8L, 8R, 8C is each connected to the power amplifier 3L, 3R, 3C as is the case of FIG. 1. The other configuration of the system of the second preferred embodiment is similar to FIG. 1.

Next the operation of above-mentioned system is described.

The headphone driving circuit of this embodiment is equipped with input terminal 6L, 6R. The left/right channel audio signal of PCM digital format is applied to each input terminal.

The left channel audio signal L and the right channel audio signal R applied to each input terminal 6L, 6R is processed by the ALU 7L so as to calculate the first difference data (L−R). Similarly the second difference data (R−L) is calculated by the ALU 7R. The ALU 7C adds the left channel audio data and the right channel audio data to generate inverted addition data (−L−R) by inverting the sign of the adding result.

The difference data (L−R) from the ALU 7L is converted to the analogue difference data (L−R)' by the DAC 8L, then supplied to the power amplifier 3L. Similarly the difference data (R−L) from the ALU 7R is converted to the analogue difference data (R−L)' by the DAC 8R, then supplied to the power amplifier 3R. The inverted adding data (−L−R) from the ALU 7C is converted to the analogue inverted adding signal (−L−R)' by the DAC 8C, then supplied to the power amplifier 3C.

Subsequent operation of the power amplifier 3L, 3R, 3C are similar to that of the first embodiment, and similar advantage is achieved.

Third Preferred Embodiment

Figure 3:
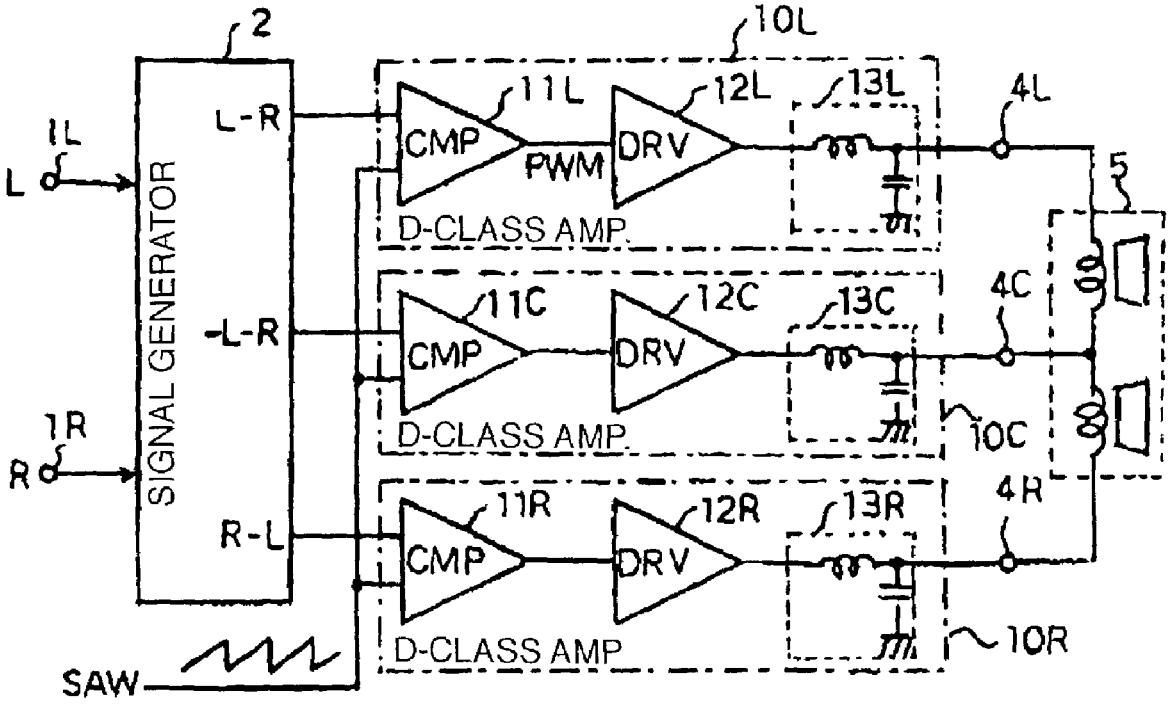
FIG. 3 is a block diagram of a third preferred embodiment of a headphone driving circuit of the invention.

FIG. 3 shows a block diagram of a headphone driving circuit of a third preferred embodiment of the invention.

In this headphone driving circuit, D-class amplifier 10L, 10R, 10C is employed alternatively to the power amplifier 3L, 3R, 3C of FIG. 1. The D-class amplifier 10L, 10R, 10C each have a same configuration. Fore example, D-class amplifier 10L includes a pulse-width modulator 11L with a comparator (CMP), a driver 12L controlled from a output signal from the pulse-width modulator 11L, a integrator 13L for integrating the output signal from the driver 12L.

The pulse-width modulator 11L compares a sawtooth shaped fixed period (e.g. 400 to 500 KHz) signal (SAW) to the difference signal (L−R) from the signal generator 2. The pulse-width modulator 11L output "H" level signal when the level of the difference signal (L−R) is higher than that of the SAW signal, and outputs "L" level signal when the level of the difference signal (L−R) is lower than that of the SAW signal. By this, a signal with pulse width proportional to the instantaneous value of the difference signal (L−R) (i.e. pulse width modulated signal (PWM)) is generated at each period of the SAW signal.

The driver 12L includes, for example, switching transistors, and generates output signal of the level nearly equal to the supply voltage when pulse-width modulated signal PWM is at "H" level. Also generates output signal of the level nearly equal to the ground voltage level when the signal PWM is at "L" level.

The integrator 13L is comprised, for example, of combination of a coil and a condenser to extract only low frequency signal and direct current signal covering an audio frequency band by eliminating a high frequency signal of the PWM signal generated from the driver 12L. By this, the difference signal (L−R) is power-amplified by the D-class amplifier 10L, then outputted to a output terminal 4L. The other configurations of the system of the third preferred embodiment are similar to that of FIG. 1.

In this headphone driving circuit, the operation of each D-class amplifier 10L, 10R, 10C differs from that of the amplifier 3L, 3R, 3C, but the other element's operations are similar to that of FIG. 1 and achieves similar advantages.

While the invention has been described with reference to illustrative embodiments, this description is not intended to be constructed in a limiting sense. There are other examples listed below.

(a) The construction of the signal generator of FIG. 1 is not restricted to the described example. Any circuit that can generate the difference signal (L−R), (R−L) and adding signal (L+R) will be used similarly.

(b) The common terminal of headphone of FIG. 1 can be drived by adding signal (L+R) as a substitute for driving inverted adding signal (−L−R) from the amplifier 3C. In this case the generated audio signal from headphone 5 is inverse in left and right channel.

(c) The pulse-width modulator of FIG. 3 can be configured by Δ-Σ modulator, that generate a pulse width signal (PWM) from a digital signal as a substitute for comparator for generating PWM signal from an analogue signal. In this case the adder and subtracter (i.e. ALU) 7 similar to FIG. 2 can be used as a substitute for analogue signal generator 2.

(d) The integrator of the D-class amplifier in FIG. 3 can be eliminated, for even if a high frequency signal is added to headphone terminal directly, it is not perceived by human ear.

As is described above, the headphone circuit of the present invention includes the first and the second amplifier to drive the voice coil of the stereo-headphone by the difference audio signal of the first channel and the second channel, the third amplifier to drive the other terminal of the voice coil. By this, twice the left channel audio signal 2L is applied to the voice coil 5L, and twice the right channel audio signal 2R is applied to the voice coil 5R. Therefore powerful acoustic sound according to the signal 2L,2R are reproduced by using relatively low power amplifiers. In addition a biasing voltage included in the generated signal from the first and the second amplifier are canceled by biasing voltage included in the signal from the third amplifier, so no bias current flow occurs in voice coil. Therefore there needs no coupling condenser at output terminals of each amplifier.

What is claimed is:

1. A headphone driving circuit comprising:

a first amplifier to amplify a first composite signal generated by subtracting a second channel audio signal from a first channel audio signal for driving one end of a first voice coil of a stereo-headphone;

a second amplifier to amplify a second composite signal generated by subtracting the first channel audio signal from the second channel audio signal for driving one end of a second voice coil of the stereo-headphone;

a third amplifier to amplify a third composite signal generated by adding the first channel audio signal and the second channel audio signal for driving the other end of the first and the second voice coil of the stereo-headphone.

2. The headphone driving circuit according to claim 1, wherein the first channel is the right channel and the second channel is the left channel, and the third amplifier inverts the sign of the third composite signal.

3. The headphone driving circuit according to claim 1, wherein the first, second, third amplifier convert an each input signal to a pulse-width modulated signal with a pulse width proportional to a instantaneous value of a sampled input signal, and a D-class amplifier generates an on/off driving signal according to the pulse-width modulated signal.

4. The headphone driving circuit according to claim 3, wherein the D-class amplifier includes a comparator, a driver, and an integrator comprised of a coil and a condenser.

5. A headphone driving circuit comprising:

a signal generator to compose a first composite signal generated by subtracting a second channel audio signal from a first channel audio signal, a second composite signal by subtracting the first channel audio signal from the second channel audio signal, and a third composite signal generated by adding the first and the second channel audio signal;

a first amplifier to drive one end of a first voice coil of a stereo-headphone by amplifying the first composite signal;

a second amplifier to drive one end of a second voice coil of the stereo-headphone by amplifying the second composite signal; and a third amplifier to drive the other end of the first and the second voice coil of the stereo-headphone by amplifying the third composite signal.

6. The headphone driving circuit according to claim 5, wherein the first channel is the right channel and the second channel is the left channel, and the sign of the third composite signal is inverted.

7. The headphone driving circuit according to claim 5, wherein the first, second, third amplifier convert an each input signal to a pulse-width modulated signal with a pulse width proportional to a instantaneous value of a sampled input signal, and a D-class amplifier generates an on/off driving signal according to the pulse-width modulated signal.

8. The headphone driving circuit according to claim 7, wherein the D-class amplifier includes a comparator, a driver, and an integrator comprised of a coil and a condenser.

9. A headphone driving circuit comprising:

an adder/subtracter unit to generate a first composite data by subtracting a second channel audio data from a first channel audio data, a second composite data by subtracting the first channel audio data from the second audio data, a third composite data by adding the first channel audio data and the second channel audio data;

digital to analogue converters to convert the first, the second and the third digital composite data to each analogue signal for generating a first, a second and a third analogue composite signal;

a first amplifier, to drive one end of a first voice coil of a stereo-headphone by the first composite data;

a second amplifier to drive one end of a second voice coil of the stereo-headphone by the second composite data; and a third amplifier to drive the other end of the first and the second voice coil of the stereo-headphone by the third composite signal.

10. The headphone driving circuit according to claim 9, wherein the adder/subtracter unit is an arithmetic logic unit (ALU) and the first channel is the right channel and the second channel is the left channel, and the sign of the third composite data is inverted.

11. The headphone driving circuit according to claim 9, wherein the first, second, third amplifier convert an each input signal to a pulse-width modulated signal with a pulse width proportional to a instantaneous value of a sampled input signal, and a D-class amplifier generates an on/off driving signal according to the pulse-width modulated signal.

12. The headphone driving circuit according to claim 11, wherein the D-class amplifier includes a comparator, a driver, and an integrator comprised of a coil and a condenser.

* * * * *